US005455153A

United States Patent [19]

Gardner

[11] Patent Number: 5,455,153

[45] Date of Patent: Oct. 3, 1995

[54] PHOTOGRAPHIC ELEMENTS CONTAINING CLAD VANADIUM PENTOXIDE ANTISTATIC LAYER

[75] Inventor: Sylvia A. Gardner, Rochester, N.Y.

[73] Assignee: Eastman Kodak Company, Rochester, N.Y.

[21] Appl. No.: 129,839

[22] Filed: Sep. 30, 1993

[51] Int. Cl.[6] ..... G03C 1/85

[52] U.S. Cl. ..... 430/530; 430/527

[58] Field of Search ..... 430/523, 527, 430/530

[56] References Cited

U.S. PATENT DOCUMENTS 4,203,769 5/1980 Guestanx ..... 430/631

5,006,451 4/1991 Anderson et al. ..... 430/527

5,030,508 7/1991 Kuhn et al. ..... 428/253

FOREIGN PATENT DOCUMENTS

4125758A1 2/1993 Germany .

*Primary Examiner*—Charles L. Bowers, Jr.
*Assistant Examiner*—Christopher G. Young
*Attorney, Agent, or Firm*—Robert A. Gerlach

[57] ABSTRACT

Clad fibrous vanadium pentoxide, antistat layers containing clad fibrous vanadium pentoxide and imaging elements containing such antistat layers.

11 Claims, No Drawings

PHOTOGRAPHIC ELEMENTS CONTAINING CLAD VANADIUM PENTOXIDE ANTISTATIC LAYER

FIELD OF THE INVENTION

This invention relates to clad vanadium pentoxide materials, to antistat layers containing such materials and to photographic elements containing an antistat layer containing the vanadium pentoxide clad materials.

DESCRIPTION OF RELATED ART

U.S. Pat. No. 4,203,769 teaches a method of preparation for vanadium pentoxide and the use of such materials in antistat layers of various types, primarily for use in photographic elements.

U.S. Pat. No. 5,006,451 is an improvement over the previously mentioned patent in that it provides for barrier layers over the vanadium pentoxide containing layer in order to impart a high level of permanent antistatic protection to the vanadium pentoxide layer. This barrier layer, for example, prevents the diffusion of the vanadium pentoxide from the photographic element during processing thereof. This diffusion represents a serious problem in that once the vanadium pentoxide is removed the antistatic action of the layer is no longer available.

There is a need in the industry to provide vanadium pentoxide, fibrous structures and layers that are not susceptible to the diffusing out of the vanadium pentoxide and the disadvantages associated therewith including the loss of antistat properties. It is also a need to provide user-friendly methods and techniques for protecting vanadium pentoxide containing articles from this disadvantage. Further, there is a need to provide protection for vanadium pentoxide containing articles of manufacture which is both transparent and colorless and not affected by ranges in humidity conditions.

SUMMARY OF THE INVENTION

This invention provides for the protection of vanadium pentoxide containing articles by providing a cladding to the articles, the cladding being the oxidation product of an oxidatively polymerizable compound. The vanadium pentoxide articles can be formed of fibrous vanadium pentoxide or can be made up of layers of particles or fibrous vanadium pentoxide prior to the cladding operation. By the term "clad" or "cladding" is meant that the fibers or articles of vanadium pentoxide are coated with a continuous film of the polymer resulting from the oxidation of an oxidatively polymerizable compound or that a discontinuous film is formed on the surface of the vanadium pentoxide material.

DESCRIPTION OF THE PREFERRED EMBODIMENTS

The term "vanadium pentoxide" as used herein includes both vanadium pentoxide ($V_2O_5$) per se, as well as doped vanadium pentoxide, the doping being other elements such as silver, lithium fluoride, calcium oxide, zinc oxide, silica, lithium carbonate, boron oxide, lithium tetraborate and the like.

While the invention is applicable to the cladding of all forms of vanadium pentoxide, including fibrous vanadium pentoxide and layers formed of particles or fibrous vanadium pentoxide for the purpose of simplicity in explanation, throughout the remainder of this specification, layers formed from vanadium pentoxide as described in U.S. Pat. No. 4,203,769 and 5,006,451 will be spoken of for the purpose of simplicity. Both of these patents are incorporated herein in their entirety.

Also, while the invention is applicable to the use of vanadium pentoxide, generally in any antistatic application, it is particularly applicable as an antistatic layer of an imaging element and in the remainder of this specification will be referred to as an antistatic layer for this purpose. By "imaging element" is meant any of the well known types such as, silver halide photographic elements, thermal imaging elements, electrophotographic elements and the like.

Useful photographic elements include those prepared on any of a wide variety of photographic supports. Typical photographic supports include polymeric film, such as, for example, cellulose nitrate and cellulose esters such as cellulose triacetate and diacetate, polystyrene, polyamides, homo- and co-polymers of vinyl chloride, poly(vinylacetal), polycarbonate, homo- and co-polymers of olefin, such as, polyethylene, polypropylene and the like, polyesters of dibasic aromatic carboxylic acids with glycols, such as, poly(ethylene terephthalate), poly(ethylene naphthalate) and the like. Photographic elements which employ paper supports coated with baryta and/or polyolefins, particularly polymers of alpha-olefins containing 2 to 10 carbon atoms in the repeating unit, such as polyethylene, polypropylene, co-polymers of ethylene and propylene and the like are also contemplated.

The polyester film supports which can be advantageously employed in this invention are well known and widely used materials. Such film supports are typically prepared from high molecular weight polyesters derived by condensing a dihydric alcohol with a dibasic saturated fatty carboxylic acid or derivatives thereof. Suitable dihydric alcohols for use in preparing polyesters are well known in the art and include any glycol wherein the hydroxyl groups are on the terminal carbon atom and contain from 2 to 12 carbon atoms such as, for example, ethylene glycol, propylene glycol, trimethylene glycol, hexamethylene glycol, decamethylene glycol, dodecamethylene glycol, and 1,4-cyclohexane dimethanol. Dibasic acids that can be employed in preparing polyesters are well known in the art and include those dibasic acids containing from 2 to 16 carbon atoms. Specific examples of suitable dibasic acids include adipic acid, sebacic acid, isophthalic acid, terephthalic acid, 1,6-naphthalene dicarboxyolic and the like. The alkyl esters of the above-enumerated acids can also be employed satisfactorily. Other suitable dihydric alcohols and dibasic acids that can be employed in preparing polyesters from which sheeting can be prepared are described in J. W. Wellman, U.S. Pat. No. 2,720,503, issued Oct. 11, 1955.

Specific preferred examples of polyester resins which, in the form of sheeting, can be used in this invention are poly(ethylene terephthalate), poly(cyclohexane 1,4-dimethylene terephthalate) and polyethylene naphthalate.

In carrying out the present invention, it is generally advantageous to employ a polymeric subbing layer between a polyester film support and the antistatic layer. Polymeric subbing layers used to promote the adhesion of coating compositions to polyester film supports are very well known in the photographic art. Useful compositions for this purpose include interpolymers of vinylidene chloride such as vinylidene chloride/acrylonitrile/acrylic acid terpolymers or vinylidene chloride/methyl acrylate/itaconic acid terpolymers. Such compositions are described in numerous patents such as for example, U.S. Pat. Nos. 2,627,088, 2,698,235, 2,698,240,2,943,937, 3,143,421, 3,201,249, 3,271,178, 3,443,950 and 3,501,301. The polymeric subbing layer is typically overcoated with a second subbing layer comprised of gelatin which is typically referred to in the art as a "gel sub".

As discussed hereinabove, the antistatic layer of this invention comprises vanadium pentoxide as the antistatic agent. The advantageous properties of vanadium pentoxide are described in detail in Guestaux, U.S. Pat. No. 4,203,769 and Anderson et al. U.S. Pat. No. 5,006,451. The antistatic layer is typically prepared by the coating of a colloidal solution of vanadium pentoxide. Preferably, the vanadium pentoxide is doped with silver. To achieve improved bonding, a polymeric binder, such as a latex of a terpolymer of acrylonitrile, vinylidene chloride and acrylic acid, can be added to the colloidal solution of vanadium pentoxide. In addition to the polymeric binder and the vanadium pentoxide, the coating composition employed to form the antistatic layer can contain a wetting agent to promote coatability.

The protective cladding layer in accordance with this invention comprises a layer which serves to clad the vanadium pentoxide or doped vanadium pentoxide fibers as a protective layer without the necessity for forming a continuous layer. The protective cladding layer is formed by applying an overcoat layer of an oxidatively polymerizable compound, which compound may be applied neat to the vanadium pentoxide or in the form of an aqueous solution, a solvent solution or as a vapor. Since vanadium pentoxide is a particularly good oxidant for the oxidatively polymerizable monomer, the polymer forms in situ to thus prepare the protective cladding layer.

While any suitable solvent may be used in the preparation of the solvent solution containing the oxidatively polymerizable monomer in accordance with this invention, such as, for example, benzene, toluene, hydrocarbons such as hexane, octane, and the like, chlorinated hydrocarbons including methylene chloride dichlorethane and the like, the preferred methods of preparing the protective polymer layer are by either aqueous solutions or by employing the oxidatively polymerizable monomer in the vapor phase. When employing an aqueous solution, it is preferred to also employ in the aqueous solution a suitable surfactant including non-ionic surfactants such as, for example, P-nonyl phenoxy polyglycidol available commercially as Olin 10 G, $C_{12}H_{25}O(CH_2CH_2O)_{10}H$ $C_{16}H_{33}O(CH_2CH_2O)_{20}H$

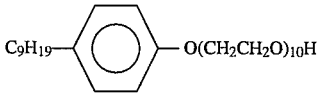

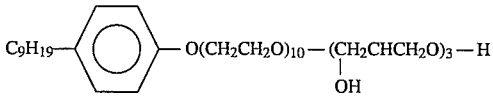

-continued

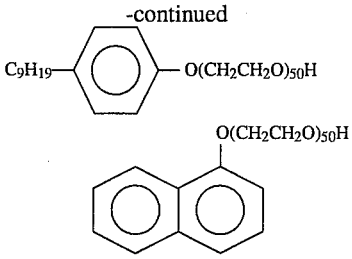

Polyoxyethylene sorbitan tristearic ester, n=30,

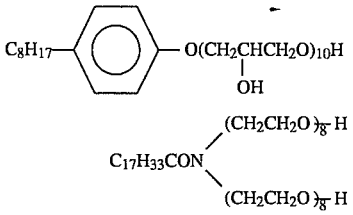

and the like.

When the oxidatively polymerizable monomer is applied in the vapor phase, it is preferred first to condition the vanadium pentoxide fibers by subjecting them initially to high relative humidity conditions for a suitable period of time. In each case, upon application of the oxidatively polymerizable monomer, the coatings are subsequently dried to produce the final fibrous vanadium pentoxide clad materials.

Because the oxidatively polymerizable monomers are generally conductive by nature, the combination of the vanadium pentoxide with the resulting polymer layers provide improved conductivity and, as a result, improved antistat layers.

Oxidatively polymerized monomers, in accordance with this invention, include anilines, pyrroles, thiophenes, furans, selenophenes and tellurophenes.

Aniline compounds suitable for use in accordance with this invention are represented by the following general formula:

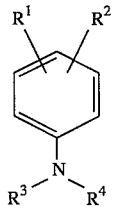

Here, $R_1$ and $R_2$ represent hydrogen, halogen (e.g., fluorine, chlorine, bromine), lkyl, aryl, hydroxyl, alkoxy, aryloxy, amino, alkylamino(may be a condensed ring), nitro, cyano, $$-NHCOR^5,\ -NHSO_2R^5,\ -SOR^5,\ -SO_2R^5,\ -SO_2\underset{\underset{R^7}{|}}{N}R^6,$$

$$-COR^5,\ -\underset{\underset{R^7}{|}}{C}ONR^6,$$

heterocyclic (e.g. triazoles, thiazoles, benzthiazoles, furans, pyridines, quinaldines, benzoxazoles, oxazoles, pyrimidines, imidazoles). $R^3$ and $R^4$ represent hydrogen, alkyl or aryl. $R^5$ represents alkyl or aryl. $R^6$ and $R^7$ can be the same or different and represent hydrogen, alkyl or aryl.

Furthermore, the alkyl groups, aryl, alkoxy, aryloxy and alkylamino of $R^1$ and $R^2$ above can be substituted. Moreover, the above alkyl and aryl of $R^3$, $R^4$, $R^5$, $R^6$ and $R^7$ can also be substituted. As examples of these substituents, alkoxy (e.g. methoxy, ethoxy), aryloxy (e.g. phenyloxy), alkoxycarbonyl (e.g. methoxycarbonyl), acylamino (e.g. acetylamino), carbamoyl, alkylcarbamoyl (e.g. methylcarbamoyl, ethylcarbamoyl), dialkylcarbamoyl (e.g. dimethylcarbamoyl), arylcarbamoyl (e.g. phenylcarbamoyl), alkylsulfonyl (e.g. methylsulfonyl), arylsulfonyl (e.g. phenylsulfonyl), alkylsulfonamide (e.g. methanesulfonamide), arylsulfonamide groups (e.g. phenylsulfonamide), sulfamoyl , alkylsulfamoyl (e.g. ethylsulfamoyl), dialkylsulfamoyl (e.g. dimethylsulfamoyl), alkylthio (e.g. methylthio), arylthio (e.g. phenylthio), amino , alkylamino , cyano, nitro and halogen (e.g. fluorine, chlorine, bromine) can be cited. When there are two or more of these substituents, they can be the same or different.

Specific examples of suitable aniline compounds include aniline, N-methylaniline, N-ethylaniline, N-phenylaniline, methylaniline, ethylaniline, n-propylaniline, iso-propylaniline, n-butylaniline, methoxyaniline, ethoxyaniline, n-propoxyaniline, phenylaniline, toluylaniline, naphthylaniline, phenoxyaniline, methylphenoxyaniline, naphthoxyaniline, aminoaniline, phenylaminoaniline, methylphenylaminoaniline, dimethylaminoaniline, diethylaminoaniline, diphenylaminoaniline, phenylnaphthylaminoaniline and the like.

Pyrrole compounds suitable for use in accordance with this invention are those represented by the following formula:

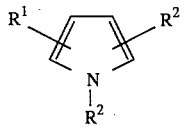

where $R^1$ and $R^2$ represent independently hydrogen, halogen, alkyl, aryl, hydroxyl, alkoxy, aryloxy, amino, alkylamino (including a contracted ring radical), nitro, cyano, $$-NHCOR^4,\ -NHSO_2R^4,\ -SOR^4,\ -SO_2R^4,\ -SO_2\underset{\underset{R^6}{|}}{N}R^5,$$

$$-COR^4,\ -CO\underset{\underset{R^6}{|}}{N}R^5,\ -COOH,\ -SH,\ -COOR^5,\ -SO_2H-,$$

or may be joined together to form a heterocyclic ring; $R^3$ represents hydrogen, alkyl, or aryl; $R^4$ represents an allkyl or aryl; $R^5$ and $R^6$ may be identical or different and they represent hydrogen, alkyl, or aryl.

In addition, the alkyl, aryl, alkoxy, aryloxy, and alkylamino represented by said $R^1$ and $R^2$ may be substituted. Besides, the alkyl or aryl represented by said $R^2$, $R^4$, $R^5$ and $R^6$ may also be substituted. Examples of the substituents include alkoxy (such as methoxy, ethoxy), aryloxy (such as phenyloxy), alkoxycarbonyl (such as methoxycarbonyl), acylamino (such as acetylamino), carbamoyl (such as methylcarbamoyl, ethylcarbamoyl), dialkylcarbamoyl (such as dimethylcarbamoyl), arylcarbamoyl (such as phenylcarbamoyl), alkylsulfonyl (such as methylsulfonyl), arylsulfonyl (such as phenylsulfonyl), alkylsulfonamide (such as methanesulfonamodo), arylsulfonamido (such as phenylsulfonamido), sulfamoyl or alkylsulfamoyl (such as ethylsulfamoyl), dialkylsulfamoyl (such as dimethylsulfamoyl), alkylthio (such as methylthio), arylthio (such as phenylthio), amino, alkylamino , cyano , nitro, halogen (such as fluorine, chlorine, bromine) and the like. It is possible to use two or more of the aforementioned substituents.

Specific examples of pyrroles include:

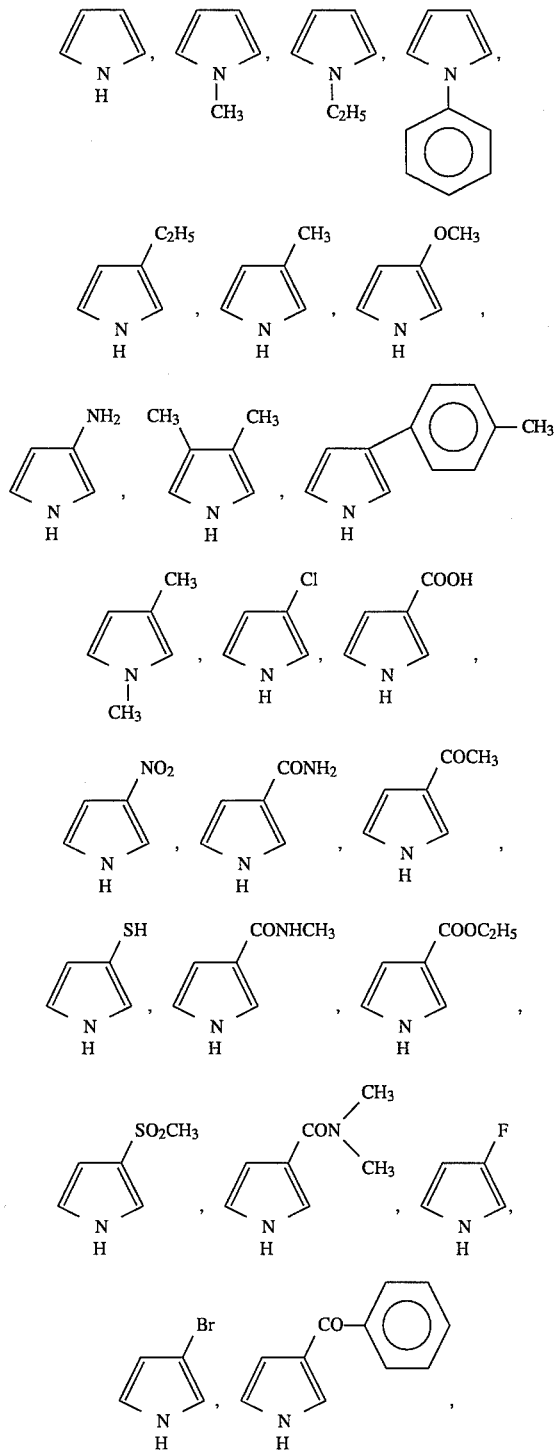

Other heterocyclic compounds for use in preparing polymers in accordance with this invention include those represented by the general formula:

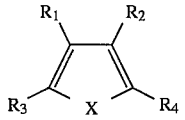

where $R^1$, $R_2$, $R^3$ and $R_4$ independently represent hydrogen, halogen (e.g. fluorine, chlorine, bromine), alkyl, aryl, hydroxyl, alkoxy, aryloxy, amino, alkylamino, nitro, cyano, —NHCOR5, —$NHSO_2R^5$, —$SOR^5$, —$SO_2R^5$, —$SO_2N(R^6)(R^7)$, —$COR^5$, —$CON(R^6)(R^7)$, —COOH, —$COOR^5$, —$SO_3H$, —SH, or a heterocyclic group (e.g. triazole, thiazole, benzothiazole, furan, pyridine, quinaldine, benzoxazole, pyrimidine, oxazole, imidazole);

$R^5$ represents alkyl or aryl;

$R^6$ and $R^7$ may be same or different and each represents hydrogen, alkyl or aryl;

X represents O, S, Te or Se;

when X is not S, $R^1$ and $R^2$, or $R^1$ and $R^3$ and/or $R^2$ and $R^4$ each may form a ring; when X is S, $R^1$ and $R^3$ and/or $R^2$ and $R^4$ each may form a ring; and in such a case, the ring to be formed may contain one or more hetero atoms.

The alkyl, aryl, alkoxy, aryloxy or alkylamino group for the above-mentioned groups $R^1$, $R^2$, $R^3$ and $R^4$ may optionally be substituted. The alkyl or aryl group for the above-mentioned groups $R^5$, $R^6$ and $R^7$ may also be optionally substituted. As examples of substituents for the groups, there are mentioned alkoxy (e.g. methoxy, ethoxy), aryloxy (e.g. phenyloxy), alkoxycarbonyl (e.g. methoxycarbonyl), acylamino (e.g. acetylamino), carbamoyl, alkylcarbamoyl (e.g. methylcarbamoyl, ethylcarbamoyl), dialkylcarbamoyl (e.g. dimethylcarbamoyl), arylcarbamoyl (e.g. phenylcarbamoyl), alkylsulfonyl (e.g. methylsulfonyl, arylsulfonyl (e.g. phenylsulfonyl), alkylsulfonamido (e.g. methanesulfonamido), arylsulfonamido (e.g. phenylsulfonamido), sulfamoyl, alkylsulfamoyl (e.g. ethylsulfamoyl), dialkylsulfamoyl (e.g. dimethylsulfamoyl), alkylthio (e.g. methylthio, arylthio (e.g. phenylthio), amino, alkylamino, cyano, nitro, and halogen (e.g. fluorine, chlorine, bromine) and the like. Where the group has two or more of such substituents, they may be the same or different from each other.

Specific examples of heterocycles of the above formula include:

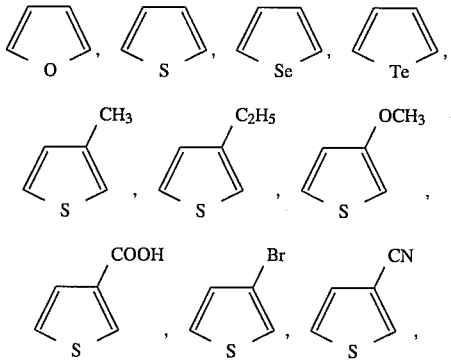

-continued

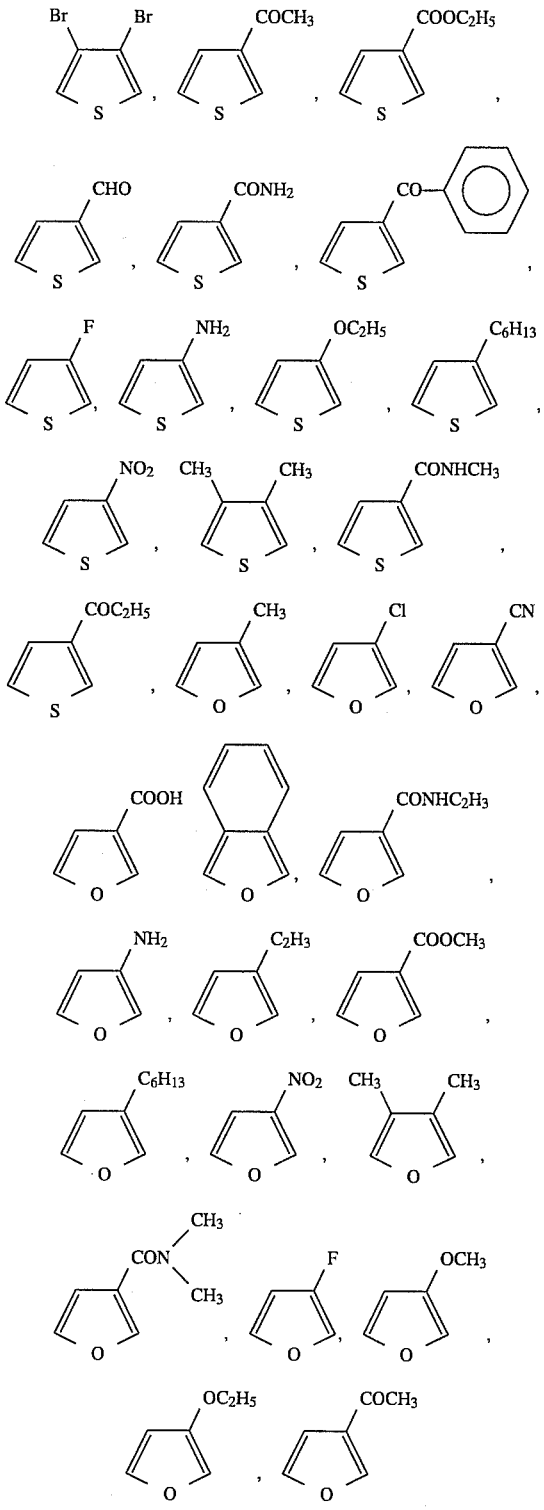

Selenium and tellurium can replace the oxygen and sulfur atoms of the above heterocyclic compounds as examples of selenophenes and tellurophenes.

The antistatic layer comprising vanadium pentoxide and the overlying cladding layer can be coated at any suitable coverage, with the optimum coverage of each depending on the particular photographic product involved. Typically, the antistatic layer is coated at a dry weight coverage of from about 1 (0.09 mg/ft$^2$) to about 25 (2.3 mg/ft$^2$) milligrams per square meter. mg/ft$^2$ is converted to mg/m$^2$ by multiplying by 10.76. Typically, the cladding layer is coated at a dry weight coverage of from about 10 to about 1000 milligrams per square meter.

Emulsions containing various types of silver salts can be used to form the silver halide layers, such as silver bromide, silver iodide, silver chloride or mixed silver halides such as silver chlorobromide, silver bromoiodide or silver chloroiodide. Typically silver halide emulsions are taught in patents listed in *Product Licensing Index*, Vol. 92, Dec. 1971, publication 9232, at page 107.

The silver halide emulsions used in combination with the conductive support of this invention can also contain other photographic compounds such as those taught in *Product Licensing Index*, op. cit., pages 107–110. The photographic compounds include development modifiers that function as speed increasing compounds, such as polyalkylene glycols, and others; anti-foggants and stabilizers such as thiazolium salts and others; hardeners, such as aldehydes, and others; vehicles, particularly hydrophilic vehicles, such as gelatin, and others; brighteners, such as stilbenes, and others; spectral sensitizers, such as merocyanines, and others; absorbing and filter dyes, such as those described in Sawdey et al. U.S. Pat. No. 2,739,971, issued Mar. 27, 1956, and others; color materials for color photography film elements, such as color-forming couplers in U.S. Pat. No. 2,376,679 issued May 22, 1945; and coating aids, such as alkyl aryl sulfonates, and others. The photographic compounds include, also, mixtures of coating aids such as those disclosed in U.S. Pat. No. 3,775,126, issued Nov. 27, 1973, which can be used in simultaneous coating operations to coat hydrophilic colloid layers on the subbing layers of elements intended for color photography, for example, layers of silver halide emulsions containing color-forming couplers or emulsions to be developed in solutions containing couplers or other color-generating materials as disclosed above.

The invention will be further illustrated by the following examples in which parts and percentages are by weight unless otherwise specified.

EXAMPLES 1–9—PREPARATION OF ANTISTAT LAYERS

An aqueous antistatic formulation comprised of 0,057 percent silver-doped vanadium pentoxide and 0.02 percent of a nonionic surfactant was coated with a doctor blade onto a polyethylene terephthalate film support which had been subbed with a terpolymer latex of acrylonitrile, vinylidene chloride and acrylic acid. The coating was air dried at 90° C. to form an antistatic layer with a dry weight of approximately 4 milligrams per square foot and a measured conductivity of $1\times10^7$ ohms/sq. An aqueous formulation comprised of 1 weight percent aniline and 0.02 weight percent nonionic surfactant was coated onto this film using a doctor blade. The coating was dried at 90° C. for 5 minutes and at 125° C. for 1 minute to form an antistatic layer with a measured conductivity of $1\times10^6$ ohms/sq. This coating was exposed to 0.05M aqueous NaOH for 1 minute to give an antistatic layer with a measured conductivity of $2\times10^9$ ohms/sq. The vanadium pentoxide coating which had not been provided with an overcoat forming a protective cladding layer had a measured conductivity of greater than $5\times10^{12}$ ohms/sq after an equivalent treatment in 0.05M NaOH. The protective cladding layer could also be formed by exposure of the vanadium layer to aniline vapor or by being dipped in neat aniline as shown below in Table 1. The protective cladding layer could also be formed by exposure of the vanadium pentoxide layer to an aqueous solution of pyrrole, to pyrrole vapor, to neat pyrrole, to an alcoholic solution of thiophene, to thiophene vapor or to neat thiophene as shown below in Table 1. All of the final antistatic coatings were colorless.

TABLE 1

| Ex 1 | Ohms/sq of $V_2O_5$ layer | Ohms/sq of $V_2O_5$ layer after 0.05 M NaOH | Treatment given to $V_2O_5$ layer | Ohms/sq of $V_2O_5$ layer after treatment | Ohms/sq of treated $V_2O_5$ layer after 0.05 M NaOH |
|---|---|---|---|---|---|
| 1 | $1\times10^7$ | $>5\times10^{12}$ | aniline coating | $1\times10^6$ | $2\times10^9$ |
| 2 | $1\times10^7$ | $>5\times10^{12}$ | aniline vapor | | $1\times10^8$ |
| 3 | $1\times10^7$ | $>5\times10^{12}$ | neat aniline | | $2\times10^9$ |
| 4 | $1\times10^7$ | $>5\times10^{12}$ | pyrrole coating | $1\times10^6$ | $2\times10^7$ |
| 5 | $1\times10^7$ | $>5\times10^{12}$ | pyrrole vapor | | $2\times10^8$ |
| 6 | $1\times10^7$ | $>5\times10^{12}$ | neat pyrrole | | $3\times10^{10}$ |
| 7 | $1\times10^7$ | $>5\times10^{12}$ | thiophene coating | $2\times10^7$ | $3\times10^7$ |
| 8 | $1\times10^7$ | $>5\times10^{12}$ | thiophene vapor | | $7\times10^8$ |
| 9 | $1\times10^7$ | $>5\times10^{12}$ | neat thiophene | | $8\times10^7$ |

EXAMPLE 10 A–G

Machine coatings of silver-doped vanadium pentoxide of varying vanadium coverages.

Aqueous antistatic formulations comprising 0.023 to 0.23 percent silver-doped vanadium pentoxide and 0.02 percent of a nonionic surfactant were machine coated onto a polyethylene terphthalate film support which had been subbed with a terpolymer latex of acylonitrile, vinylidene chloride and acrylic acid. The measured vanadium coverages by Inductively Coupled Argon Plasma/Optical Emission Spectroscopy (ICP/OES) are given in Table 2. Each coating was exposed to 0.05M NaOH for 5 or for 15 seconds and the conductivities and vanadium coverages were measured. These results are given in Table 2.

TABLE 2

| Example No. | $V_2O_5$ Coverage by ICP/OES (mg $V_2O_5/ft^2$) | OHMS/sq | $V_2O_5$ Coverage after 5 sec 0.05 M NaOH ($mg/ft^2$) | OHMS/sq after 5 sec 0.05 M NaOH | $V_2O_5$ Coverage after 15 sec 0.05 M NaOH ($mg/ft^2$) | OHMS/sq after 15 sec 0.05 M NaOH |
|---|---|---|---|---|---|---|
| 10A | 0.222 | $5.33 \times 10^9$ | 0.058 | $5.00 \times 10^{12}$ | 0.056 | $9 \times 10^{11}$ |
| 10B | 0.464 | $5.67 \times 10^8$ | 0.069 | $5.00 \times 10^{12}$ | 0.04 | $5 \times 10^{12}$ |
| 10C | 1.02 | $4.97 \times 10^7$ | 0.031 | $5.00 \times 10^{12}$ | 0.044 | $1 \times 10^{12}$ |
| 10D | 0.92 | $6.97 \times 10^7$ | 0.06 | $5.00 \times 10^{12}$ | 0.051 | $5 \times 10^{12}$ |
| 10E | 1.34 | $3.10 \times 10^7$ | 0.049 | $5.00 \times 10^{12}$ | 0.056 | $5 \times 10^{12}$ |
| 10F | 1.45 | $3.12 \times 10^7$ | 0.049 | $5.00 \times 10^{12}$ | 0.038 | $5 \times 10^{12}$ |
| 10G (Hand Coating 0.57%) | 3.43 | $2.00 \times 10^7$ | 0.18 | $2.00 \times 10^8$ | 0.056 | $2 \times 10^{12}$ |

EXAMPLE 11

Preparation of Base Resistant Antistat Layers from machine coatings of silver doped vanadium pentoxide of Varying vanadium coverage and monomer overcoats.

The $V_2O_5$ films described in Example 10 were conditioned at 100% RH. An aqueous formulation comprised of 1 percent aniline and 0.02 percent nonionic surfactant was coated onto the films using a doctor blade. The coatings were dried at 90° C. for 5 minutes and a 125° C. for 1 minute to form antistatic layers. The conductivities of these coatings are shown in Table 3. The films described in Example 10 were also coated with solutions of pyrrole or thiophene. These results are also given in Table 3.

If the $V_2O_5$ films described in Example 11 were not conditioned at 100% RH and were coated as above, the protective cladding layer was not formed, showing that the coatings of the vanadium oxide must be freshly coated or in a slightly water swollen condition. These results are given in Table 4.

TABLE 3

| Example No. | OHMS/sq after overcoat (1% aniline in water) | OHMS/sq-overcoat (1% aniline in water) & 15 sec 0.05 M NaOH | OHMS/sq after overcoat (1% pyrrole in water) | OHMS/sq after overcoat (1% pyrrole in water) & 15 sec 0.05 M NaOH | OHMS/sq after overcoat (1% thiophene in EtOH) | OHMS/sq after overcoat (1% thiophene in EtOH) & 15 sec 0.05 M NaOH |
|---|---|---|---|---|---|---|
| | Conditioned at 100% RH | | | | | |
| 11A | $5.00 \times 10^{12}$ | $5.00 \times 10^{12}$ | $5.00 \times 10^{12}$ | $5.00 \times 10^{12}$ | $5.00 \times 10^{12}$ | $5.00 \times 10^{12}$ |
| 11B | $5.70 \times 10^{8}$ | $2.00 \times 10^{10}$ | $6.40 \times 10^{8}$ | $7.30 \times 10^{9}$ | $6.70 \times 10^{8}$ | $7.80 \times 10^{9}$ |
| 11C | $4.90 \times 10^{7}$ | $7.00 \times 10^{9}$ | $5.90 \times 10^{7}$ | $5.10 \times 10^{9}$ | $5.30 \times 10^{8}$ | $3.20 \times 10^{9}$ |
| 11D | $8.80 \times 10^{7}$ | $6.30 \times 10^{9}$ | $6.60 \times 10^{7}$ | $9.00 \times 10^{8}$ | $3.80 \times 10^{7}$ | $1.20 \times 10^{8}$ |
| 11E | $3.70 \times 10^{6}$ | $2.10 \times 10^{10}$ | $4.20 \times 10^{6}$ | $4.40 \times 10^{8}$ | $5.20 \times 10^{6}$ | $9.70 \times 10^{8}$ |
| 11F | $4.20 \times 10^{6}$ | $7.40 \times 10^{8}$ | $4.90 \times 10^{6}$ | $1.10 \times 10^{8}$ | $6.20 \times 10^{6}$ | $1.30 \times 10^{8}$ |
| 11G (Hand 0.57%) | $2.00 \times 10^{6}$ | $4.00 \times 10^{8}$ | $1.00 \times 10^{6}$ | $1.00 \times 10^{7}$ | $2.00 \times 10^{7}$ | $2.00 \times 10^{7}$ |

TABLE 4

| Example No. | OHMS/sq after overcoat (1% aniline in water) | OHMS/sq-overcoat (1% aniline in water) & 15 sec 0.05 M NaOH | OHMS/sq after overcoat (1% pyrrole in water) | OHMS/sq after overcoat (1% pyrrole in water) & 15 sec 0.05 M NaOH | OHMS/sq after overcoat (1% thiophene in EtOH) | OHMS/sq after overcoat (1% thiophene in EtOH) & 15 sec 0.05 M NaOH |
|---|---|---|---|---|---|---|
| | Not Conditioned at 100% RH | | | | | |
| 11A | $5.00 \times 10^{12}$ | $5.00 \times 10^{12}$ | $5.00 \times 10^{12}$ | $5.00 \times 10^{12}$ | $5.00 \times 10^{12}$ | $5.00 \times 10^{12}$ |
| 11B | $4.50 \times 10^{8}$ | $5.00 \times 10^{12}$ | $6.20 \times 10^{8}$ | $5.00 \times 10^{12}$ | $7.10 \times 10^{8}$ | $5.00 \times 10^{12}$ |
| 11C | $6.10 \times 10^{7}$ | $5.00 \times 10^{12}$ | $5.70 \times 10^{7}$ | $5.00 \times 10^{12}$ | $4.60 \times 10^{8}$ | $5.00 \times 10^{12}$ |
| 11D | $9.20 \times 10^{7}$ | $5.00 \times 10^{12}$ | $8.40 \times 10^{7}$ | $5.00 \times 10^{12}$ | $7.70 \times 10^{7}$ | $5.00 \times 10^{12}$ |
| 11E | $4.00 \times 10^{6}$ | $5.00 \times 10^{12}$ | $5.30 \times 10^{6}$ | $5.00 \times 10^{12}$ | $7.30 \times 10^{6}$ | $5.00 \times 10^{12}$ |
| 11F | $4.10 \times 10^{6}$ | $5.00 \times 10^{12}$ | $5.10 \times 10^{6}$ | $5.00 \times 10^{12}$ | $7.50 \times 10^{6}$ | $5.00 \times 10^{12}$ |
| 11G (Hand 0.57%) | $3.00 \times 10^{6}$ | $4.00 \times 10^{9}$ | $1.00 \times 10^{6}$ | $2.00 \times 10^{7}$ | $2.00 \times 10^{7}$ | $3.00 \times 10^{7}$ |

EXAMPLE 12

Preparation of Base Resistant Antistat Layers from machine coatings of silver doped vanadium pentoxide of varying vanadium coverage and monomer vapor.

The films described in Example 10 were conditioned at 100% RH and exposed to aniline, pyrrole or thiophene vapor. The coatings were dried at 125° C. for 1 minute to form antistatic layers. The conductivities of these coatings are shown in Table 5.

If the films described in Example 12 were not conditioned at 100% RH and were exposed to aniline, thiophene, or pyrrole vapor as above, the protective cladding layer was not formed, showing that the coatings of the vanadium oxide must be freshly coated or in a slightly water swollen condition. These results are given in Table 6.

TABLE 5

| Example No. | OHMS/sq after 1 hr aniline vapor | OHMS/sq 1 hr aniline vapor & 15 sec 0.05 M NaOH | OHMS/sq after 1 hr pyrrole vapor | OHMS/sq after 1 hr pyrrole vapor & 15 sec 0.05 M NaOH | OHMS/sq after 1 hr thiophene vapor | OHMS/sq after 1 hr thiophene vapor & 15 sec 0.05 M NaOH |
|---|---|---|---|---|---|---|
| | Conditioned at 100% RH and Exposed to Monomer Vapor | | | | | |
| 12A | $5.00 \times 10^{12}$ | $5.00 \times 10^{12}$ | $5.00 \times 10^{12}$ | $5.00 \times 10^{12}$ | $5.00 \times 10^{12}$ | $5.00 \times 10^{12}$ |
| 12B | $9.80 \times 10^{9}$ | $1.30 \times 10^{10}$ | $1.80 \times 10^{10}$ | $2.50 \times 10^{10}$ | $8.80 \times 10^{10}$ | $5.00 \times 10^{10}$ |
| 12C | $8.70 \times 10^{9}$ | $8.70 \times 10^{9}$ | $5.20 \times 10^{9}$ | $7.50 \times 10^{9}$ | $3.00 \times 10^{10}$ | $5.30 \times 10^{9}$ |
| 12D | $4.20 \times 10^{9}$ | $7.20 \times 10^{9}$ | $8.70 \times 10^{9}$ | $5.30 \times 10^{9}$ | $4.70 \times 10^{9}$ | $4.10 \times 10^{9}$ |
| 12E | $3.10 \times 10^{9}$ | $8.60 \times 10^{8}$ | $1.20 \times 10^{9}$ | $9.00 \times 10^{8}$ | $3.80 \times 10^{9}$ | $5.20 \times 10^{8}$ |
| 12F | $5.40 \times 10^{8}$ | $7.20 \times 10^{8}$ | $6.80 \times 10^{8}$ | $6.00 \times 10^{8}$ | $5.60 \times 10^{8}$ | $9.00 \times 10^{8}$ |
| 12G (Hand 0.57%) | $1.00 \times 10^{7}$ | $2.40 \times 10^{8}$ | $1.00 \times 10^{7}$ | $2.70 \times 10^{8}$ | $1.00 \times 10^{7}$ | $7.70 \times 10^{8}$ |

TABLE 6

| Example No. | OHMS/sq after 1 hr aniline vapor | OHMS/sq 1 hr aniline vapor & 15 sec 0.05 M NaOH | OHMS/sq after 1 hr pyrrole vapor | OHMS/sq after 1 hr pyrrole vapor & 15 sec 0.05 M NaOH | OHMS/sq after 1 hr thiophene vapor | OHMS/sq after 1 hr thiophene vapor & 15 sec 0.05 M NaOH |
|---|---|---|---|---|---|---|
| | Not Conditioned at 100% RH | | | | | |
| Example No. | OHMS/sq after overcoat (1% aniline in water) | OHMS/sq-overcoat (1% aniline in water) & 15 sec 0.05 M NaOH | OHMS/sq after overcoat (1% pyrrole in water) | OHMS/sq after overcoat (1% pyrrole in water) & 15 sec 0.05 M NaOH | OHMS/sq after overcoat (1% thiophene in EtOH) | OHMS/sq after overcoat (1% thiophene in EtOH) & 15 sec 0.05 M NaOH |
| 12A | $5.00 \times 10^{12}$ | $5.00 \times 10^{12}$ | $5.00 \times 10^{12}$ | $5.00 \times 10^{12}$ | $5.00 \times 10^{12}$ | $5.00 \times 10^{12}$ |
| 12B | $2.00 \times 10^{10}$ | $5.00 \times 10^{12}$ | $1.10 \times 10^{10}$ | $5.00 \times 10^{12}$ | $8.90 \times 10^{9}$ | $5.00 \times 10^{12}$ |
| 12C | $8.90 \times 10^{9}$ | $5.00 \times 10^{12}$ | $7.80 \times 10^{9}$ | $5.00 \times 10^{12}$ | $1.00 \times 10^{10}$ | $5.00 \times 10^{12}$ |
| 12D | $5.34 \times 10^{9}$ | $5.00 \times 10^{12}$ | $3.30 \times 10^{9}$ | $5.00 \times 10^{12}$ | $4.50 \times 10^{9}$ | $5.00 \times 10^{12}$ |
| 12E | $3.30 \times 10^{9}$ | $5.00 \times 10^{12}$ | $3.40 \times 10^{9}$ | $5.00 \times 10^{12}$ | $3.60 \times 10^{9}$ | $5.00 \times 10^{12}$ |
| 12F | $8.70 \times 10^{8}$ | $5.00 \times 10^{12}$ | $7.60 \times 10^{8}$ | $5.00 \times 10^{12}$ | $6.50 \times 10^{8}$ | $5.00 \times 10^{12}$ |
| 12G (Hand 0.57%) | $1.00 \times 10^{7}$ | $2.40 \times 10^{8}$ | $1.00 \times 10^{7}$ | $2.70 \times 10^{8}$ | $1.00 \times 10^{7}$ | $7.70 \times 10^{8}$ |

EXAMPLE 13

TEM examination of Base Resistant Antistat Layers made with aniline monomer.

A sample of 50 microliters of a 0.57 percent solution of silver-doped vanadium pentoxide was diluted into 10 milliliters of ultrapure water. A four microliter drop of this solution was placed on a copper grid which had been coated with a holey carbon film and air dried for 5 minutes and then in a 125° C. oven for 1 minute. The TEM of this sample showed the fibrous nature of the antistat layer. Micrographs taken of this sample on the holey carbon grid after exposure of the sample to 30 sec in 0.05M NaOH showed that this immersion in base was sufficient to remove all of the fibrous silver-doped vanadium pentoxide in the antistat layer.

Samples of silver-doped vanadium pentoxide prepared above on a holey carbon film were treated with a two microliter drop of a 1 weight percent solution of aniline in water, air dried and then oven dried for 1 minute.

The aniline-treated sample prepared above was then immersed for 30 seconds in 0.05M NaOH, air dried and then oven dried for 1 min. The TEM of this sample shows that some of the fibrous silver-doped vanadium pentoxide layer still remains due to the protective cladding layer formed by interaction of the aniline monomer with the antistat layer.

EXAMPLE 14

TEM examination of Base Resistant Antistat Layers made with thiophene monomer.

A sample of 50 microliters of a 0.57 percent solution of silver-doped vanadium pentoxide was diluted into 10 milliliters of ultrapure water. A four microliter drop of this solution was placed on a copper grid which had been coated with a holey carbon film and air dried for 5 minutes and then in a 125° C. oven for 1 minute. The TEM of this sample showed the fibrous nature of the antistat layer. Micrographs taken of this sample on the holey carbon grid after exposure of the sample 30 seconds in 0.05M NaOH shows that this immersion in base was sufficient to remove all of the fibrous silver-doped vanadium pentoxide in the antistat layer.

Samples of silver-doped vanadium pentoxide prepared above on a holey carbon film were treated with a two microliter drop of a 1 weight percent solution of thiophene in ethanol, air dried and then oven dried for 1 minute.

The thiophene-treated sample prepared above was then immersed for 30 seconds in 0.05M NaOH, air dried and then oven dried for 1 minute. The TEM of this sample shows that some of the fibrous silver-doped vanadium pentoxide layer still remains due to the protective cladding layer formed by interaction of the thiophene monomer with the antistat layer.

EXAMPLE 15

TEM examination of Base Resistant Antistat Layers made with pyrrole monomer.

A sample of 50 microliters of a 0.57 weight percent solution of silver-doped vanadium pentoxide was diluted into 10 milliliters of ultrapure water. A four microliter drop of this solution was placed on a copper grid which had been coated with a holey carbon film and air dried for 5 minutes and then in a 125° C. oven for 1 minute. The TEM of this sample showed the fibrous nature of the antistat layer. Micrographs taken of this sample on the holey carbon grid after exposure of the sample to 30 seconds in 0.05M NaOH showed that this immersion in base was sufficient to remove all of the fibrous silver-doped vanadium pentoxide in the antistat layer.

Samples of silver-doped vanadium pentoxide prepared above on a holey carbon film were treated with a two microliter drop of a 1 weight percent solution of pyrrole in water, air dried and then oven dried for 1 minute.

The pyrrole-treated sample prepared above was then immersed for 30 seconds in 0.05M NaOH, air dried and then oven dried for 1 minute. The TEM of this sample shows that some of the fibrous silver-doped vanadium pentoxide layer still remains due to the protective cladding layer formed by interaction of the pyrrole monomer with the antistat layer.

EXAMPLE 16

Reaction of aniline with silver-doped vanadium pentoxide under strongly acidic conditions.

The films described in Example 10 were conditioned at 100% RH and an aqueous formulation comprised of 1 percent aniline in 1.2M HCl and 0.02 weight percent nonionic surfactant was coated onto the films using a doctor blade. The coatings were dried at 90° C. for 5 minutes and at 125° C. for 1 minute. The loss in conductivity of these coatings after immersion in 0.05M NaOH is shown in Table 7, showing that reaction of the aniline monomer with the silver-doped vanadium pentoxide layer under the highly acidic reaction conditions under which reactions producing polyaniline are commonly run did not result in the formation of a protective cladding layer on the silver-doped vanadium pentoxide fibers. TEM examination of samples under these conditions (samples prepared as in Examples 13, 14 and 15 but reacted with aniline in 1.2M HCl) showed no fibrous silver-doped vanadium pentoxide after immersion in 0.05M NaOH.

The NaOH immersed samples in Table 7 did regain conductivity after immersion in 1.2M HCl, washing and drying, showing that a conductive form of polyaniline could be regenerated after reaction of the aniline monomer with the silver-doped vanadium pentoxide layer under highly acidic conditions. The results are shown in the right hand column of Table 7.

TABLE 7

| Example No. | $V_2O_5$ Coverage ICP/OES (mg $V_2O_5$/ft$^2$) | OHMS/sq | OHMS/sq after 1.2 M HCl overcoat | OHMS/sq after overcoat (1% aniline in 1.2 M HCl) | OHMS/sq -overcoat (1% aniline in 1.2 M Cl) and water wash | OHMS/sq -overcoat (1% aniline in 1.2 M HCl)/water wash/ 0.5 M NaOH | OHMS/sq after ctgs in previous column dipped in 1.2 M HCl/wash/dry |
|---|---|---|---|---|---|---|---|
| 16A | 0.222 | $5.33 \times 10^9$ | $5.00 \times 10^{12}$ | $5.00 \times 10^{12}$ | $5.00 \times 10^{12}$ | $5.00 \times 10^{12}$ | $5.00 \times 10^{12}$ |
| 16B | 0.464 | $5.67 \times 10^8$ | $5.00 \times 10^{12}$ | $4.77 \times 10^7$ | $9.63 \times 10^8$ | $5.00 \times 10^{12}$ | $7.00 \times 10^8$ |
| 16C | 1.02 | $4.97 \times 10^7$ | $5.00 \times 10^{12}$ | $4.33 \times 10^6$ | $6.50 \times 10^7$ | $5.00 \times 10^{12}$ | $2.00 \times 10^8$ |
| 16D | 0.92 | $6.97 \times 10^7$ | $5.00 \times 10^{12}$ | $2.33 \times 10^6$ | $3.07 \times 10^8$ | $5.00 \times 10^{12}$ | $7.00 \times 10^8$ |
| 16E | 1.34 | $3.10 \times 10^7$ | $5.00 \times 10^{12}$ | $1.00 \times 10^6$ | $2.43 \times 10^7$ | $5.00 \times 10^{12}$ | $2.00 \times 10^{10}$ |
| 16F | 1.45 | $3.12 \times 10^7$ | $5.00 \times 10^{12}$ | $1.00 \times 10^6$ | $9.30 \times 10^6$ | $5.00 \times 10^{12}$ | $1.00 \times 10^{10}$ |
| 16G (Hand 0.57%) | 3.43 | $2.00 \times 10^7$ | $1.10 \times 10^9$ | $2.00 \times 10^6$ | $6.00 \times 10^6$ | $5.00 \times 10^{12}$ | $2.00 \times 10^8$ |

EXAMPLE 17

Preparation of Base Resistant Antistat Layers.

A series of vanadium pentoxide gels containing a variety of different dopants were used to make antistat layers. These alternately doped gels are listed in Table 8.

TABLE 8

| Example No. | OHMS/sq (.057%/3 mil wet) | OHMS/sq (after 1 min base) | V4+ | Ag | LiF | CaO | ZnO | SiO2 | LiCO3 | B2O3 | LiB4O7 | % solids |
|---|---|---|---|---|---|---|---|---|---|---|---|---|
| 17A | $8.1 \times 10^7$ | $5.0 \times 10^{12}$ | 4.85 | 9.31 | 0.63 | | | | | | | 4.73 |
| 17B | $3.53 \times 10^7$ | $5.0 \times 10^{12}$ | 6.21 | 8.93 | 0.58 | | | | | | | 4.91 |
| 17C | $2.67 \times 10^7$ | $5.0 \times 10^{12}$ | 7.22 | 8.27 | 0.54 | | | | | | | 2.7 |
| 17D | $5.40 \times 10^7$ | $5.0 \times 10^{12}$ | 4.85 | 7.94 | 0.61 | | | | | | | 4.87 |
| 17E | $7.87 \times 10^7$ | $5.0 \times 10^{12}$ | 3.23 | | | | | | | | | 4.9 |
| 17F | $1.46 \times 10^8$ | $5.0 \times 10^{12}$ | 4.8 | | | | | | | | | 4.76 |
| 17G | $3.37 \times 10^8$ | $5.0 \times 10^{12}$ | 6.93 | | | | | | | | | 4.71 |
| 17H | $6.17 \times 10^7$ | $5.0 \times 10^{12}$ | 11.08 | | | | | | | | | 4.71 |
| 17I | $1.20 \times 10^9$ | $5.0 \times 10^{12}$ | 1.67 | | | | | | | | | 3.66 |
| 17J | $3.44 \times 10^9$ | $5.0 \times 10^{12}$ | 0.91 | | | | | | | | | 3.65 |
| 17K | $2.09 \times 10^8$ | $5.0 \times 10^{12}$ | 3.44 | | | | | | | | | 3.98 |
| 17L | $8.27 \times 10^7$ | $5.0 \times 10^{12}$ | 5.17 | | | 2 | | | | | | 4.4 |
| 17M | $1.54 \times 10^8$ | $5.0 \times 10^{12}$ | 5.34 | | | 3 | | | | | | 4.16 |
| 17N | $1.07 \times 10^8$ | $5.0 \times 10^{12}$ | 4.8 | | | | 2 | | | | | 4.39 |
| 17O | $7.13 \times 10^7$ | $5.0 \times 10^{12}$ | 4.89 | | | | 3 | | | | | 4.3 |
| 17P | $2.30 \times 10^7$ | $5.0 \times 10^{12}$ | 5.03 | 4 | | | | 4 | | | | 4.29 |
| 17Q | $1.50 \times 10^7$ | $5.0 \times 10^{12}$ | 4.87 | 4 | | | | 8 | | | | 4.07 |
| 17R | $2.60 \times 10^7$ | $5.0 \times 10^{12}$ | 5.28 | 4 | | | | 4 | | | | 4.26 |
| 17S | $3.40 \times 10^7$ | $5.0 \times 10^{12}$ | 5.45 | 4 | | | | | 4 | | | 4.39 |
| 17T | $7.00 \times 10^6$ | $5.0 \times 10^{12}$ | 5.53 | 4 | | | | | 4 | | | 2.49 |
| 17U | $3.51 \times 10^8$ | $5.0 \times 10^{12}$ | 6.02 | 4 | | | | | 8 | | | 4.43 |
| 17V | $1.07 \times 10^9$ | $5.0 \times 10^{12}$ | 4.44 | | | | | 4 | | | | 3.79 |
| 17W | $2.14 \times 10^9$ | $5.0 \times 10^{12}$ | 4.07 | | | | | 8 | | | | 4.29 |
| 17X | $2.06 \times 10^9$ | $5.0 \times 10^{12}$ | 4.28 | | | | | 4 | | | | 4.13 |
| 17Y | $1.44 \times 10^9$ | $5.0 \times 10^{12}$ | 4.3 | | | | | 8 | | | | 3.76 |
| 17Z | $4.70 \times 10^9$ | $5.0 \times 10^{12}$ | 4.54 | | | | | | | 4 | | 4.28 |
| 17A1 | $9.20 \times 10^7$ | $5.0 \times 10^{12}$ | 4.71 | 4 | | | | | | 4 | | 4.32 |
| 17B1 | $2.14 \times 10^9$ | $5.0 \times 10^{12}$ | 4.49 | | | | | | | | 4 | 4.15 |
| 17C1 | $3.60 \times 10^7$ | $5.0 \times 10^{12}$ | 4.55 | 4 | | | | | | | 4 | 4.32 |

An aqueous antistatic formulation comprised of 0,057 percent of the doped vanadium pentoxide of Table 8 and 0.02 weight percent of a nonionic surfactant was coated with a doctor blade onto a polyethylene terephthalate film support which had been subbed with a terpolymer latex of acrylonitrile, vinylidene chloride and acrylic acid. The coatings were air dried at 90° C. to form antistatic layers with dry weights of approximately 4 milligrams per square foot. An aqueous formulation comprised of 1 percent aniline and 0.02 percent nonionic surfactant was coated onto these films using a doctor blade. The coatings were dried at 90° C. for 5 minutes and at 125° C. for 1 minute to form antistatic layers. These coatings were exposed to 0.05M aqueous NaOH for 1 minute to give antistatic layers with measured conductivities as shown in Table 9. The vanadium pentoxide coatings which had not been provided with an overcoat forming a protective cladding layer had a measured conductivity of greater than $5\times10^{12}$ ohms/sq after an equivalent treatment in 0.05M NaOH. All of the final antistatic coatings were colorless.

TABLE 9

| Example No. | OHMS/sq (.057%/3 mil wet) | OHMS/sq (after 1 min base) | OHMS/sq (after aniline) | OHMS/sq (aniline + 1 min 0.05 M NaOH) |
|---|---|---|---|---|
| 17A | $8.10 \times 10^7$ | $5.00 \times 10^{12}$ | $4.00 \times 10^7$ | $6.90 \times 10^9$ |
| 17B | $3.53 \times 10^7$ | $5.00 \times 10^{12}$ | $1.90 \times 10^7$ | $4.10 \times 10^9$ |
| 17C | $2.67 \times 10^7$ | $5.00 \times 10^{12}$ | $3.00 \times 10^6$ | $3.80 \times 10^9$ |
| 17D | $5.40 \times 10^7$ | $5.00 \times 10^{12}$ | $4.80 \times 10^7$ | $1.90 \times 10^{10}$ |
| 17E | $7.87 \times 10^7$ | $5.00 \times 10^{12}$ | $9.00 \times 10^6$ | $3.00 \times 10^6$ |
| 17F | $1.46 \times 10^8$ | $5.00 \times 10^{12}$ | $4.00 \times 10^8$ | $9.90 \times 10^7$ |
| 17G | $3.37 \times 10^8$ | $5.00 \times 10^{12}$ | $1.00 \times 10^8$ | $4.20 \times 10^8$ |
| 17H | $6.17 \times 10^7$ | $5.00 \times 10^{12}$ | $4.40 \times 10^7$ | $3.20 \times 10^9$ |
| 171 | $1.20 \times 10^9$ | $5.00 \times 10^{12}$ | $2.30 \times 10^8$ | $2.60 \times 10^8$ |
| 17J | $3.44 \times 10^9$ | $5.00 \times 10^{12}$ | $5.60 \times 10^8$ | $3.10 \times 10^9$ |
| 17K | $2.09 \times 10^8$ | $5.00 \times 10^{12}$ | $3.40 \times 10^7$ | $4.70 \times 10^8$ |
| 17L | $8.27 \times 10^7$ | $5.00 \times 10^{12}$ | $4.90 \times 10^7$ | $5.00 \times 10^9$ |
| 17M | $1.54 \times 10^8$ | $5.00 \times 10^{12}$ | $5.20 \times 10^7$ | $5.40 \times 10^9$ |
| 17N | $1.07 \times 10^8$ | $5.00 \times 10^{12}$ | $3.60 \times 10^7$ | $4.10 \times 10^9$ |
| 17O | $7.13 \times 10^7$ | $5.00 \times 10^{12}$ | $6.10 \times 10^7$ | $9.20 \times 10^8$ |
| 17P | $2.30 \times 10^7$ | $5.00 \times 10^{12}$ | $1.80 \times 10^7$ | $1.20 \times 10^9$ |
| 17Q | $1.50 \times 10^7$ | $5.00 \times 10^{12}$ | $4.20 \times 10^7$ | $3.30 \times 10^9$ |
| 17R | $2.60 \times 10^7$ | $5.00 \times 10^{12}$ | $6.80 \times 10^6$ | $6.70 \times 10^8$ |
| 17S | $3.40 \times 10^7$ | $5.00 \times 10^{12}$ | $9.20 \times 10^6$ | $2.10 \times 10^9$ |
| 17T | $7.00 \times 10^6$ | $5.00 \times 10^{12}$ | $2.00 \times 10^6$ | $3.80 \times 10^9$ |
| 17U | $3.51 \times 10^8$ | $5.00 \times 10^{12}$ | $1.70 \times 10^8$ | $4.40 \times 10^9$ |
| 17V | $1.07 \times 10^9$ | $5.00 \times 10^{12}$ | $2.40 \times 10^8$ | $3.10 \times 10^9$ |
| 17W | $2.14 \times 10^9$ | $5.00 \times 10^{12}$ | $2.40 \times 10^8$ | $4.70 \times 10^9$ |
| 17X | $2.06 \times 10^9$ | $5.00 \times 10^{12}$ | $2.70 \times 10^8$ | $1.20 \times 10^9$ |
| 17Y | $1.44 \times 10^9$ | $5.00 \times 10^{12}$ | $3.80 \times 10^8$ | $5.50 \times 10^9$ |
| 17Z | $4.70 \times 10^9$ | $5.00 \times 10^{12}$ | $4.20 \times 10^8$ | $6.40 \times 10^9$ |
| 17A1 | $9.20 \times 10^7$ | $5.00 \times 10^{12}$ | $9.00 \times 10^6$ | $2.20 \times 10^8$ |
| 17B1 | $2.14 \times 10^9$ | $5.00 \times 10^{12}$ | $4.10 \times 10^8$ | $9.10 \times 10^9$ |
| 17C1 | $3.60 \times 10^7$ | $5.00 \times 10^{12}$ | $2.60 \times 10^7$ | $3.30 \times 10^8$ |

EXAMPLE 18

Preparation of Base Resistant Antistat Layers using alternately doped vanadium Pentoxide gels and Pyrrole.

A series of vanadium Pentoxide gels containing a variety of different dopants were used to make antistat layers. These alternately doped gels are listed in Table 8.

An aqueous antistatic formulation comprised of 0.057 weight percent of a doped vanadium Pentoxide and 0.02 weight percent of a nonionic surfactant was coated with a doctor blade onto a Polyethylene terephthalate film support which had been subbed with a terpolymer latex of acrylonitrile, vinylidene chloride and acrylic acid. The coatings were air dried at 90° C. to form antistatic layers with dry weights of approximately 4 milligrams per square foot. An aqueous formulation comprised of 1 percent pyrrole and 0.02 percent nonionic surfactant was coated onto these films using a doctor blade. The coatings were dried at 90° C. for 5 minutes and at 125° C. for 1 minute to form antistatic layers. These coatings were exposed to 0.05M aqueous NaOH for 1 minute to give antistatic layers with measured conductivities as shown in Table 10. Vanadium pentoxide coatings which had not been provided with an overcoat forming a protective cladding layer had a measured conductivity of greater than $5\times10^{12}$ ohms/sq after an equivalent treatment in 0.05M NaOH. All of the final antistatic coatings were colorless.

18K $2.09 \times 10^8$
$5.00 \times 10^{12}$
$2.20 \times 10^7$ $5.80 \times 10^7$

18L $8.27 \times 10^7$
$5.00 \times 10^{12}$
$3.60 \times 10^7$ $3.50 \times 10^8$

18M $1.54 \times 10^8$
$5.00 \times 10^{12}$
$5.10 \times 10^7$ $4.20 \times 10^8$

18N $1.07 \times 10^8$
$5.00 \times 10^{12}$
$4.80 \times 10^7$ $8.40 \times 10^8$

18O $7.13 \times 10^7$
$5.00 \times 10^{12}$
$5.40 \times 10^7$ $3.60 \times 10^8$

18P $2.30 \times 10^7$
$5.00 \times 10^{12}$
$1.90 \times 10^7$ $6.50 \times 10^8$

18Q $1.50 \times 10^7$
$5.00 \times 10^{12}$
$3.20 \times 10^7$ $3.30 \times 10^8$

18R $2.60 \times 10^7$
$5.00 \times 10^{12}$
$9.10 \times 10^6$ $2.80 \times 10^8$
18S
$3.40 \times 10^7$
$5.00 \times 10^{12}$
$9.00 \times 10^6$
$2.20 \times 10^9$
18T
$7.00 \times 10^6$
$5.00 \times 10^{12}$
$2.00 \times 10^6$
$2.80 \times 10^9$
18U
$3.51 \times 10^8$
$5.00 \times 10^{12}$
$3.10 \times 10^8$
$5.00 \times 10^9$
18V
$1.07 \times 10^9$
$5.00 \times 10^{12}$
$1.70 \times 10^8$
$1.80 \times 10^{10}$
18W
$2.14 \times 10^9$
$5.00 \times 10^{12}$
$4.20 \times 10^8$
$4.70 \times 10^9$
18X
$2.06 \times 10^9$
$5.00 \times 10^{12}$
$2.70 \times 10^8$
$2.20 \times 10^9$
18Y
$1.44 \times 10^9$
$5.00 \times 10^{12}$
$2.70 \times 10^8$
$9.60 \times 10^8$
18Z
$4.70 \times 10^9$
$5.00 \times 10^{12}$
$3.40 \times 10^8$
$2.30 \times 10^9$
18A1
$9.20 \times 10^7$
$5.00 \times 10^{12}$
$8.10 \times 10^6$
$3.20 \times 10^9$
18B1
$2.14 \times 10^9$
$5.00 \times 10^{12}$
$2.30 \times 10^8$
$4.70 \times 10^9$
18C1
$3.60 \times 10^7$
$5.00 \times 10^{12}$
$5.60 \times 10^7$
$4.20 \times 10^9$

EXAMPLE 19

Preparation of Base Resistant Antistat Layers using alternately doped vanadium Pentoxide gels and thiophene.

A series of vanadium Pentoxide gels containing a variety of different dopants were used to make antistat layers. These alternately doped gels are listed in Table 8.

An aqueous antistatic formulation comprised of 0.057 Percent of a doped vanadium Pentoxide and 0.02 percent of a nonionic surfactant was coated with a doctor blade onto a polyethylene terephthalate film support which had been subbed with a terpolymer latex of acrylonitrile, vinylidene chloride and acrylic acid. The coatings were air dried at 90° C. to form antistatic layers with dry weights of approximately 4 milligrams per square foot. An alcoholic formulation comprised of 1 weight percent thiophene was coated onto these films using a doctor blade. The coatings were dried at 90° C. for 5 minutes and at 125° C. for 1 minute to form antistatic layers. These coatings were exposed to 0.05M aqueous NaOH for 1 minute to give antistatic layers with measured conductivities as shown in Table 11. The vanadium pentoxide coatings which had not been provided with an overcoat forming a protective cladding layer had a measured conductivity of greater than $5 \times 10^{12}$ ohms/sq after an equivalent treatment in 0.05M NaOH. All of the final antistatic coatings were Colorless.

TABLE 11

| Example No. | OHMS/sq (.057%/3 mil wet) | OHMS/sq (after 1 min base) | OHMS/sq (after thiophene) | OHMS/sq (thiophene + 1 min 0.05 M NaOH) |
|---|---|---|---|---|
| 19A | $8.10 \times 10^7$ | $5.00 \times 10^{12}$ | $5.00 \times 10^7$ | $8.00 \times 10^9$ |
| 19B | $3.53 \times 10^7$ | $5.00 \times 10^{12}$ | $1.60 \times 10^7$ | $5.20 \times 10^9$ |
| 19C | $2.67 \times 10^7$ | $5.00 \times 10^{12}$ | $7.00 \times 10^6$ | $3.00 \times 10^9$ |
| 19D | $5.40 \times 10^7$ | $5.00 \times 10^{12}$ | $6.00 \times 10^7$ | $1.20 \times 10^{10}$ |
| 19E | $7.87 \times 10^7$ | $5.00 \times 10^{12}$ | $8.00 \times 10^6$ | $6.00 \times 10^6$ |
| 19F | $1.46 \times 10^8$ | $5.00 \times 10^{12}$ | $2.00 \times 10^8$ | $9.10 \times 10^7$ |
| 19G | $3.37 \times 10^8$ | $5.00 \times 10^{12}$ | $9.20 \times 10^7$ | $1.20 \times 10^8$ |
| 19H | $6.17 \times 10^7$ | $5.00 \times 10^{12}$ | $4.20 \times 10^7$ | $1.20 \times 10^{10}$ |
| 19I | $1.20 \times 10^7$ | $5.00 \times 10^{12}$ | $1.90 \times 10^8$ | $3.80 \times 10^8$ |
| 19i | $3.44 \times 10^9$ | $5.00 \times 10^{12}$ | $6.60 \times 10^8$ | $2.90 \times 10^{10}$ |
| 19K | $2.09 \times 10^8$ | $5.00 \times 10^{12}$ | $1.40 \times 10^7$ | $4.00 \times 10^6$ |
| 19L | $8.27 \times 10^7$ | $5.00 \times 10^{12}$ | $9.30 \times 10^7$ | $3.70 \times 10^8$ |
| 19M | $1.54 \times 10^8$ | $5.00 \times 10^{12}$ | $7.10 \times 10^7$ | $1.20 \times 10^9$ |
| 19N | $1.07 \times 10^8$ | $5.00 \times 10^{12}$ | $6.40 \times 10^7$ | $1.10 \times 10^9$ |
| 19O | $7.13 \times 10^7$ | $5.00 \times 10^{12}$ | $4.00 \times 10^7$ | $9.70 \times 10^8$ |
| 19P | $2.30 \times 10^7$ | $5.00 \times 10^{12}$ | $1.10 \times 10^7$ | $5.50 \times 10^9$ |
| 19Q | $1.50 \times 10^7$ | $5.00 \times 10^{12}$ | $3.40 \times 10^7$ | $3.20 \times 10^9$ |
| 19R | $2.60 \times 10^7$ | $5.00 \times 10^{12}$ | $6.00 \times 10^6$ | $8.00 \times 10^8$ |
| 19S | $3.40 \times 10^7$ | $5.00 \times 10^{12}$ | $7.00 \times 10^6$ | $2.80 \times 10^9$ |
| 19T | $7.00 \times 10^6$ | $5.00 \times 10^{12}$ | $2.00 \times 10^6$ | $2.80 \times 10^9$ |
| 19U | $3.51 \times 10^8$ | $5.00 \times 10^{12}$ | $1.10 \times 10^8$ | $5.60 \times 10^9$ |
| 19V | $1.07 \times 10^9$ | $5.00 \times 10^{12}$ | $1.40 \times 10^8$ | $5.00 \times 10^9$ |
| 19W | $2.14 \times 10^9$ | $5.00 \times 10^{12}$ | $2.20 \times 10^8$ | $1.70 \times 10^9$ |

TABLE 11-continued

| Example No. | OHMS/sq (.057%/3 mil wet) | OHMS/sq (after 1 min base) | OHMS/sq (after thiophene) | OHMS/sq (thiophene + 1 min 0.05 M NaOH) |
|---|---|---|---|---|
| 19X | $2.06 \times 10^9$ | $5.00 \times 10^{12}$ | $2.30 \times 10^8$ | $2.00 \times 10^9$ |
| 19Y | $1.44 \times 10^9$ | $5.00 \times 10^{12}$ | $1.80 \times 10^8$ | $4.40 \times 10^9$ |
| 19Z | $4.70 \times 10^9$ | $5.00 \times 10^{12}$ | $4.20 \times 10^8$ | $8.60 \times 10^9$ |
| 19A1 | $9.20 \times 10^7$ | $5.00 \times 10^{12}$ | $8.50 \times 10^6$ | $4.10 \times 10^9$ |
| 19B1 | $2.14 \times 10^9$ | $5.00 \times 10^{12}$ | $2.10 \times 10^8$ | $8.80 \times 10^9$ |
| 19C1 | $3.60 \times 10^7$ | $5.00 \times 10^{12}$ | $1.60 \times 10^7$ | $9.40 \times 10^8$ |

EXAMPLE 20

Reaction of aniline with alternately-doped pentoxide under strongly acidic conditions.

The films of alternately doped vanadium pentoxides described in Examples 17–19 (Table 8) were coated with an aqueous formulation comprised of 1 weight Percent aniline in 1.2M HCl and 0.02 weight percent nonionic surfactant using a doctor blade. The coatings were dried at 90° C. for 5 minutes and at 125° C. for 1 minute. The loss in conductivity of these coatings after immersion in 0.05M NaOH is shown in Table 12, showing that reaction of the aninline monomer with the doped vanadium pentoxide layer under the highly acidic reaction conditions under which reactions producing polyaniline are commonly run did not result in the formation of a protective cladding layer on the doped vanadium pentoxide fibers.

TABLE 12

| Example No. | OHMS/sq (.057%/3 mil wet) | OHMS/sq (after 1 min base) | OHMS/sq after overcoat (1% aniline in 1.2 M HCl) | OHMS/sq after overcoat (1% aniline in 1.2 M HCl) & water wash | OHMS/sq after aniline/ HCl/overcoat and 1 min in 0.05 M NaOH |
|---|---|---|---|---|---|
| 20A | $8.10 \times 10^7$ | $5.00 \times 10^{12}$ | $1.00 \times 10^6$ | $1.50 \times 10^6$ | $5.00 \times 10^{12}$ |
| 20B | $3.53 \times 10^7$ | $5.00 \times 10^{12}$ | $1.00 \times 10^6$ | $1.00 \times 10^6$ | $5.00 \times 10^{12}$ |
| 20C | $2.67 \times 10^7$ | $5.00 \times 10^{12}$ | $1.00 \times 10^6$ | $6.50 \times 10^6$ | $5.00 \times 10^{12}$ |
| 20D | $5.40 \times 10^7$ | $5.00 \times 10^{12}$ | $1.00 \times 10^6$ | $2.00 \times 10^6$ | $5.00 \times 10^{12}$ |
| 20E | $7.87 \times 10^7$ | $5.00 \times 10^{12}$ | $1.00 \times 10^6$ | $1.50 \times 10^6$ | $5.00 \times 10^{12}$ |
| 20F | $1.46 \times 10^8$ | $5.00 \times 10^{12}$ | $1.00 \times 10^6$ | $4.00 \times 10^6$ | $5.00 \times 10^{12}$ |
| 20G | $3.37 \times 10^8$ | $5.00 \times 10^{12}$ | $2.00 \times 10^6$ | $7.00 \times 10^6$ | $5.00 \times 10^{12}$ |
| 20H | $6.17 \times 10^7$ | $5.00 \times 10^{12}$ | $4.50 \times 10^6$ | $4.20 \times 10^7$ | $5.00 \times 10^{12}$ |
| 20I | $1.20 \times 10^9$ | $5.00 \times 10^{12}$ | $6.00 \times 10^6$ | $4.80 \times 10^7$ | $5.00 \times 10^{12}$ |
| 20J | $3.44 \times 10^9$ | $5.00 \times 10^{12}$ | $2.50 \times 10^6$ | $4.20 \times 10^7$ | $5.00 \times 10^{12}$ |
| 20K | $2.09 \times 10^8$ | $5.00 \times 10^{12}$ | $1.50 \times 10^6$ | $3.50 \times 10^6$ | $5.00 \times 10^{12}$ |
| 20L | $8.27 \times 10^7$ | $5.00 \times 10^{12}$ | $1.00 \times 10^6$ | $4.00 \times 10^6$ | $5.00 \times 10^{12}$ |
| 20M | $1.54 \times 10^8$ | $5.00 \times 10^{12}$ | $1.00 \times 10^6$ | $1.50 \times 10^7$ | $5.00 \times 10^{12}$ |
| 20N | $1.07 \times 10^8$ | $5.00 \times 10^{12}$ | $1.00 \times 10^6$ | $1.60 \times 10^7$ | $5.00 \times 10^{12}$ |
| 20O | $7.13 \times 10^7$ | $5.00 \times 10^{12}$ | $1.00 \times 10^6$ | $1.20 \times 10^7$ | $5.00 \times 10^{12}$ |
| 20P | $2.30 \times 10^7$ | $5.00 \times 10^{12}$ | $1.00 \times 10^6$ | $3.00 \times 10^6$ | $5.00 \times 10^{12}$ |
| 20Q | $1.50 \times 10^7$ | $5.00 \times 10^{12}$ | $1.00 \times 10^6$ | $2.00 \times 10^6$ | $5.00 \times 10^{12}$ |
| 20R | $2.60 \times 10^7$ | $5.00 \times 10^{12}$ | $1.00 \times 10^6$ | $7.20 \times 10^6$ | $5.00 \times 10^{12}$ |
| 20S | $3.40 \times 10^7$ | $5.00 \times 10^{12}$ | $1.00 \times 10^6$ | $4.50 \times 10^7$ | $5.00 \times 10^{12}$ |
| 20T | $7.00 \times 10^6$ | $5.00 \times 10^{12}$ | $1.00 \times 10^6$ | $7.00 \times 10^6$ | $5.00 \times 10^{12}$ |
| 20U | $3.51 \times 10^8$ | $5.00 \times 10^{12}$ | $1.00 \times 10^6$ | $4.00 \times 10^6$ | $5.00 \times 10^{12}$ |
| 20V | $1.07 \times 10^9$ | $5.00 \times 10^{12}$ | $1.00 \times 10^6$ | $1.60 \times 10^7$ | $5.00 \times 10^{12}$ |
| 20W | $2.14 \times 10^9$ | $5.00 \times 10^{12}$ | $1.00 \times 10^6$ | $4.70 \times 10^6$ | $5.00 \times 10^{12}$ |
| 20X | $2.06 \times 10^9$ | $5.00 \times 10^{12}$ | $1.00 \times 10^6$ | $4.00 \times 10^6$ | $5.00 \times 10^{12}$ |
| 20Y | $1.44 \times 10^9$ | $5.00 \times 10^{12}$ | $1.00 \times 10^6$ | $2.00 \times 10^6$ | $5.00 \times 10^{12}$ |
| 20Z | $4.70 \times 10^9$ | $5.00 \times 10^{12}$ | $1.00 \times 10^6$ | $1.60 \times 10^7$ | $5.00 \times 10^{12}$ |
| 20A1 | $9.20 \times 10^7$ | $5.00 \times 10^{12}$ | $1.00 \times 10^6$ | $5.30 \times 10^6$ | $5.00 \times 10^{12}$ |
| 20B1 | $2.14 \times 10^9$ | $5.00 \times 10^{12}$ | $1.00 \times 10^6$ | $4.00 \times 10^6$ | $5.00 \times 10^{12}$ |
| 20C1 | $3.60 \times 10^7$ | $5.00 \times 10^{12}$ | $1.00 \times 10^6$ | $1.60 \times 10^7$ | $5.00 \times 10^{12}$ |

I claim:

1. A photographic imaging element comprising a support, at least one light sensitive layer and an antistat layer comprising vanadium pentoxide fibers clad with a polymer formed by the oxidation of an oxidatively polymerizable compound.

2. The imaging element of claim 1 wherein the light sensitive layer contains silver halide.

3. The imaging element of claim 1 wherein the oxidatively polymerizable compound is selected from the group consisting of an aniline compound, a pyrrole compound, a thiophene compound, a furan compound, a tellurophene compound, a selenophene compound and mixtures thereof.

4. The imaging element of claim 1 wherein the oxidatively polymerizable compound is an aniline compound.

5. The imaging element of claim 1 wherein the oxidatively polymerizable compound is a pyrrole compound.

6. The imaging element of claim 1 wherein the oxidatively polymerizable compound is a thiophene compound.

7. The imaging element of claim 1 wherein the oxidatively polymerizable compound is a furan compound.

8. The imaging element of claim 1 wherein the oxidatively polymerizable compound is a tellurophene compound.

9. The imaging element of claim 1 wherein the oxidatively polymerizable compound is a selenophene compound.

10. The imaging element of claim 1 wherein the vanadium pentoxide contains a doping agent.

11. The imaging element of claim 10 wherein the doping agent is silver.

* * * * *